US008075056B2

(12) United States Patent
Glöckl

(10) Patent No.: US 8,075,056 B2
(45) Date of Patent: Dec. 13, 2011

(54) SUPPORT ELEMENT FOR SEATING FURNITURE

(76) Inventor: Josef Glöckl, Kirchheim Bei München (DE)

( * ) Notice: Subject to any disclaimer, the term of this patent is extended or adjusted under 35 U.S.C. 154(b) by 693 days.

(21) Appl. No.: 11/883,139

(22) PCT Filed: Feb. 3, 2006

(86) PCT No.: PCT/EP2006/000969

§ 371 (c)(1),
(2), (4) Date: Jul. 26, 2007

(87) PCT Pub. No.: WO2006/082083

PCT Pub. Date: Aug. 10, 2006

(65) Prior Publication Data

US 2008/0143162 A1 Jun. 19, 2008

(30) Foreign Application Priority Data

Feb. 3, 2005 (DE) ..... 10 2005 005 089
Feb. 3, 2005 (DE) ..... 20 2005 001 741 U

(51) Int. Cl.
*A47C 3/02* (2006.01)
*A47C 1/00* (2006.01)

(52) U.S. Cl. ..... 297/258.1; 297/313; 297/344.21; 297/451.7

(58) Field of Classification Search ..... 297/258.1, 297/313, 314, 316, 344.21, 451.7; 248/599, 248/157, 161
See application file for complete search history.

(56) References Cited

U.S. PATENT DOCUMENTS

| | | | | |
|---|---|---|---|---|
| 1,619,069 | A * | 3/1927 | Glasner et al. | 72/351 |
| 1,930,021 | A | 10/1933 | Powell | |
| 3,193,237 | A | 7/1965 | Adams | |
| 3,304,043 | A | 2/1967 | Beck | |
| 4,858,880 | A | 8/1989 | Durand | |
| 5,044,587 | A * | 9/1991 | Degen | 248/158 |
| 6,601,818 | B1 * | 8/2003 | Larsen | 248/621 |
| 7,547,067 | B2 * | 6/2009 | Keilhauer et al. | 297/313 |

FOREIGN PATENT DOCUMENTS

| | | |
|---|---|---|
| EP | 1 106 111 A1 | 6/2001 |
| FR | 1170615 | 1/1959 |
| FR | 1341308 | 10/1963 |

OTHER PUBLICATIONS

International Preliminary Search Report in corresponding PCT application No. PCT/EP2006/000969.

* cited by examiner

*Primary Examiner* — Sarah B McPartlin
(74) *Attorney, Agent, or Firm* — Harness, Dickey & Pierce, PLC

(57) ABSTRACT

An office chair has a seating element with an upright tubular element (3) and a base, the seating element being connected to the base by means of the support element (1) so as to be swiveled and reset. Rubber buffers (19, 24) are provided between a connecting element (2) of the base, ring discs (11) and (17) and a tubular element (8) extending from the seating element downward and allow an oscillating movement of the seating element. The rubber buffers at least partially enclose the connecting element (2), thereby retaining the same. A pneumatic spring (4) allows to adjust the height of the seat. A thumb screw (16) allows to adjust the restoring force by compressing the rubber buffers (19, 24) to a greater or lesser extent.

14 Claims, 8 Drawing Sheets

SUPPORT ELEMENT FOR SEATING FURNITURE

CROSS-REFERENCE TO RELATED APPLICATIONS

This application is a U.S. National Stage Application of International Application No. PCT/EP2006/000969, filed on Feb. 3, 2006 and published in German as WO 2006/082083 A1 on Aug. 10, 2006. This application claims the benefit of DE Application Nos. 20 2005 001 741.8, filed on Feb. 3, 2005 and 10 2005 005 089.1, filed on Feb. 3, 2005. The disclosure (s) of the above applications are incorporated herein by reference.

The invention relates to a supporting element for a seating furniture item, particularly for an office chair, the seating furniture item comprising a seat with a jointing element and a base. In addition, the invention relates to a seating furniture item, particularly an office chair comprising the supporting element.

Persons spending a lot of time seated suffer from degeneration of the muscles of the back and a deformed posture. The resulting backache may even develop into serious health problems. Persons afflicted are those who have to work long-hours seated. When concentrating in using a computer, for example, maintaining a good seating posture is not always remembered. On top of this, adjusting conventional office chairs is mainly restricted to height adjustment by a gas spring and spring suspension of the chair back. Seating with a dynamic response is possible only to a very restricted degree.

This is why ergonomic seating furniture item have been developed with the aid of which the user can assume a more favorable seating posture. In addition, some of these seats permit movements achieving training and strengthening the muscles of the back in the seated posture in preventing a one-sided strain on the back.

Known from prior art are ergonomic seats which permit movement of the seat with a series of differing degrees of freedom. For instance, the seat can be connected via a suspension to a leg or surface standing the chair, the suspension permitting a bobbing motion or sideways tilting of the seat.

European patent EP 1 106 111 A1 shows a bar stool featuring a return device. Arranged between a seat and a base are an intermediate part with a central column and a suspension structure. At its bottom end the intermediate part is held in the base free to tilt and return. The return device which returns the seat from its tilted position to its basic position is configured as a rubber bonded metal item. The restoring force can be set by preloading with the aid of a set nut.

Dynamic bobbing and swinging motion is thus afforded to the user of the bar stool achieving an ergonomic favorable effect by the seating posture being changed all the time.

As a rule, however, the production of such sophisticated mechanical systems achieving such flexible, dynamic seating is complicated and expensive.

Apart from this, retrofitting existing office chairs with such systems is impractical.

Also desirable would be means of optimally setting the restoring force instantly without complication, it being particularly as regards an office chair alternatingly used by different persons that a speedy means of making the setting is needed.

On the basis of these requirements the object of the present invention is to provide a supporting element for an office chair which now makes it possible to gently swing the seat relative to the base in thus achieving dynamic and ergonomically favorable seating. In addition to this it is intended that the supporting element is suitable for retrofitting to existing office chairs in now permitting the restoring forces to be simply set personalized.

With the supporting element in accordance with the invention for a seating furniture item having a jointing element and a base, the base is now supported free to be tilted and returned at the jointing element by means of a resilient element.

More particularly the base now features a jointing part which is clasped at least in part by the resilient element to support the base at the jointing element in thus achieving a gimbal mount.

The resilient element is preferably configured so that the jointing part of the base can be clamped in place by the resilient element.

The resilient element is disposed particularly between an upper stopper and the jointing part of the base and between a lower stopper and the jointing part of the base.

The stoppers can be secured to the jointing part of the seat. The connection may be rigid, but at least one of the stoppers may be secured to the jointing element height-adjustable. The jointing part of the seat is configured particularly as a stanchion tube extending downwards.

The jointing part of the base is preferably in contact with the outer surface of the resilient element, although it is just as possible that the jointing part is clasped from without when the supporting element is configured suitably inclined. The resilient element may comprise at least two flanges extending outwardly, between which the jointing part of the base is disposed in thus preventing particularly contact with the stoppers.

The resilient element is particularly made up of at least two separate parts each configured angled. In this arrangement the jointing part of the base rests in the angled recesses to facilitate replacing a resilient element when worn out due to heavy duty. In addition, a more rugged rubber blend may be used for such a heavy duty element.

The resilient element features preferably at least one rubber buffer

In another embodiment the resilient element is configured in one piece as a sleeve having supporting shoulders at both ends, the jointing part of the base being located in the recess between the shoulders. The one-piece rubber buffer may be provided with one or more hollows to accommodate flexing of the rubber buffer when loaded.

The resilient element may be made of at least one elastomer, particularly polyurethane or natural rubber possibly vulcanizing a helical compression spring in place. The resilient element is engineered with cavities in the material and/or recesses in the surfaces contacting adjoining components to accommodate a change in shape of the resilient element so that when the seat is loaded, material can flex into the cavities. The recesses may be configured to achieve a personalized motion and restoring force for ergonomically favorable seating.

The supporting element comprises more particularly means for setting and varying the restoring force of the resilient element.

The supporting element preferably comprises an actuator for setting and varying the restoring force of the resilient element in particularly permitting continuous setting and varying of the restoring force. In addition to this, the restoring force of the resilient element can be set and varied incrementally.

These means are engineered particularly to vary the spacing between an upper stopper and a lower stopper. The stopper spacing is variable to permit adjustable deformation of the resilient element. Varying the spacing of the stoppers can be set, for instance, by means of a wing nut arranged at the bottom end of the rigid element. It is also possible to set the spacing of the stoppers by a cam disposed between a flange and a stopper.

As an alternative, the means for varying the spacing may be configured between the jointing part of the base and the jointing element of the seat, for instance by means of a tubular piece shiftingly mounting at least one conical element for setting and varying the restoring force of the resilient element. The radius of the rigid element can also be varied to set and vary the restoring force of the resilient element. The means may also be engineered to compress the resilient element from without.

The object is also achieved by a seating furniture item, particularly an office chair having a seat and a base, the seat comprising a supporting element as described above. The seating furniture item comprises more particularly a height-adjustable gas spring connecting the seat.

Further features and advantages of the invention read from the following example embodiments as shown in the drawings in which FIG. 1 is a side view of a supporting element for an office chair in cross-section;

Figure 5A:
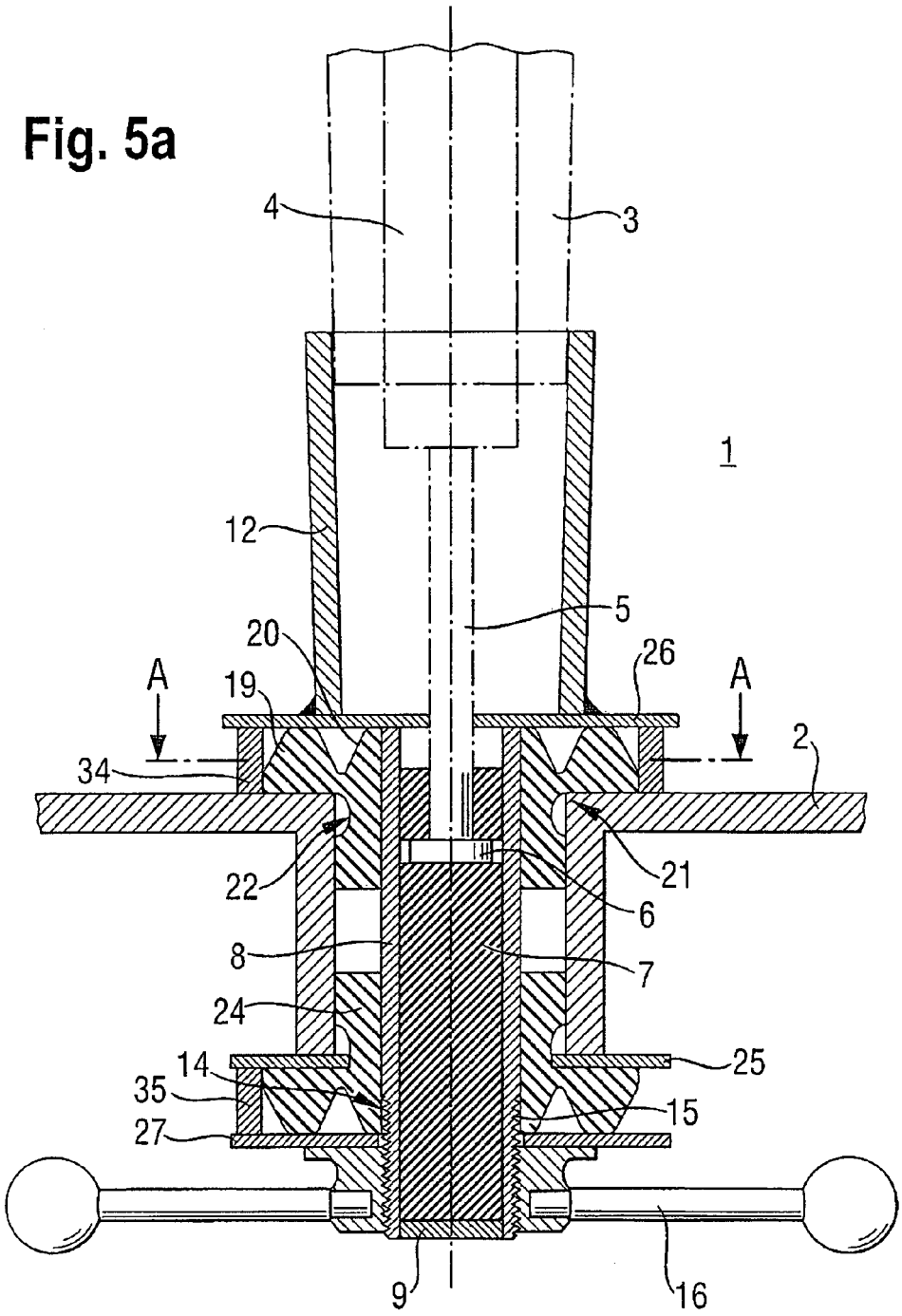
Figure 5B:
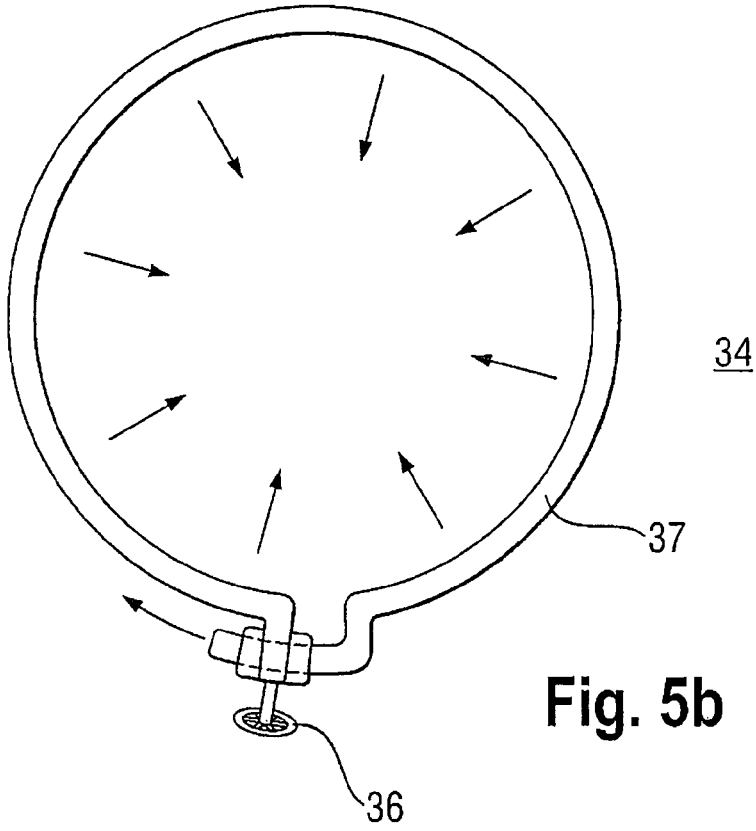
Figure 5C:
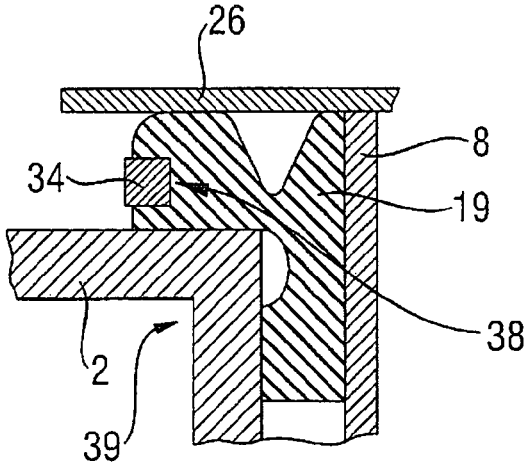
Figure 6:
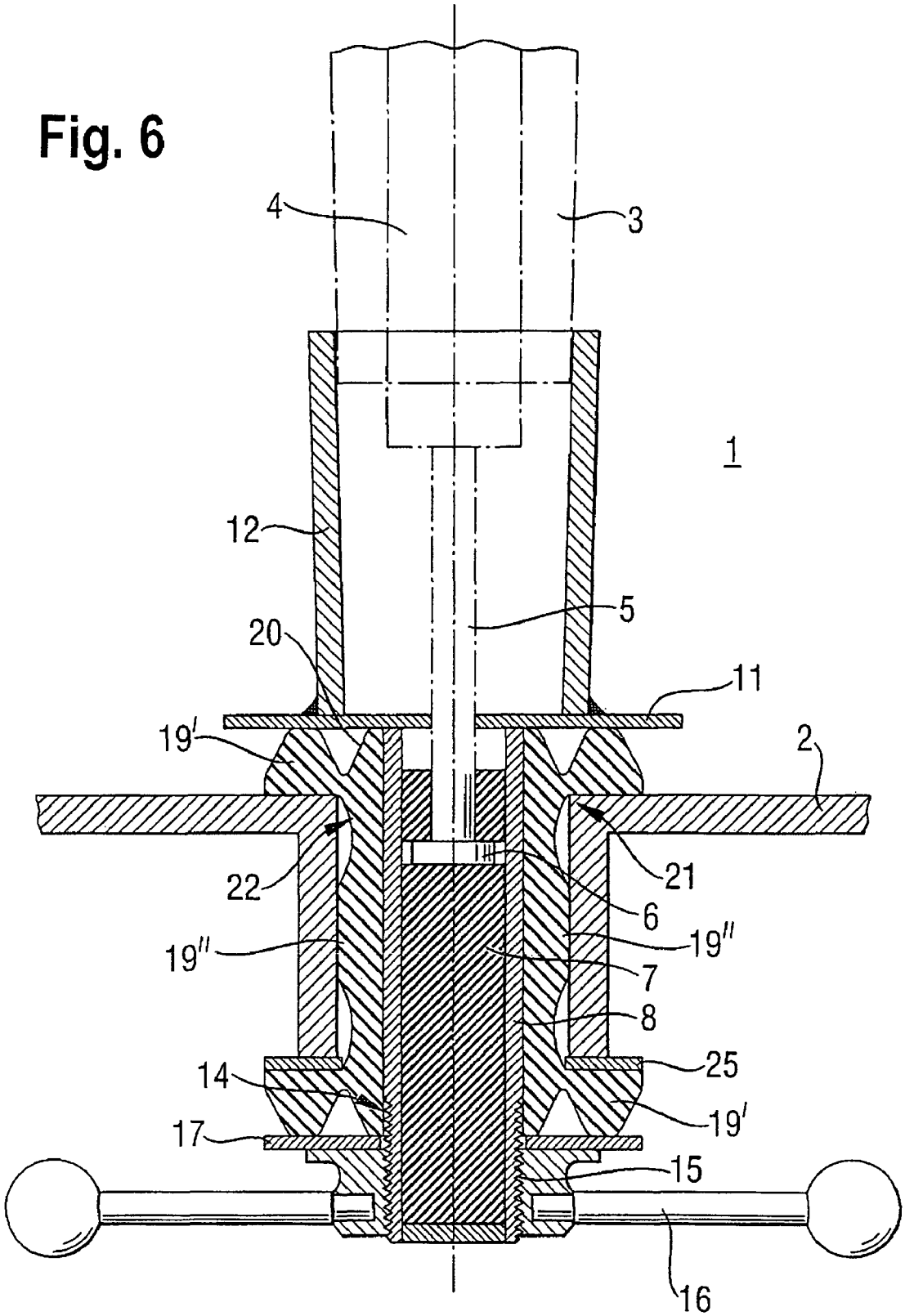
Figure 7:
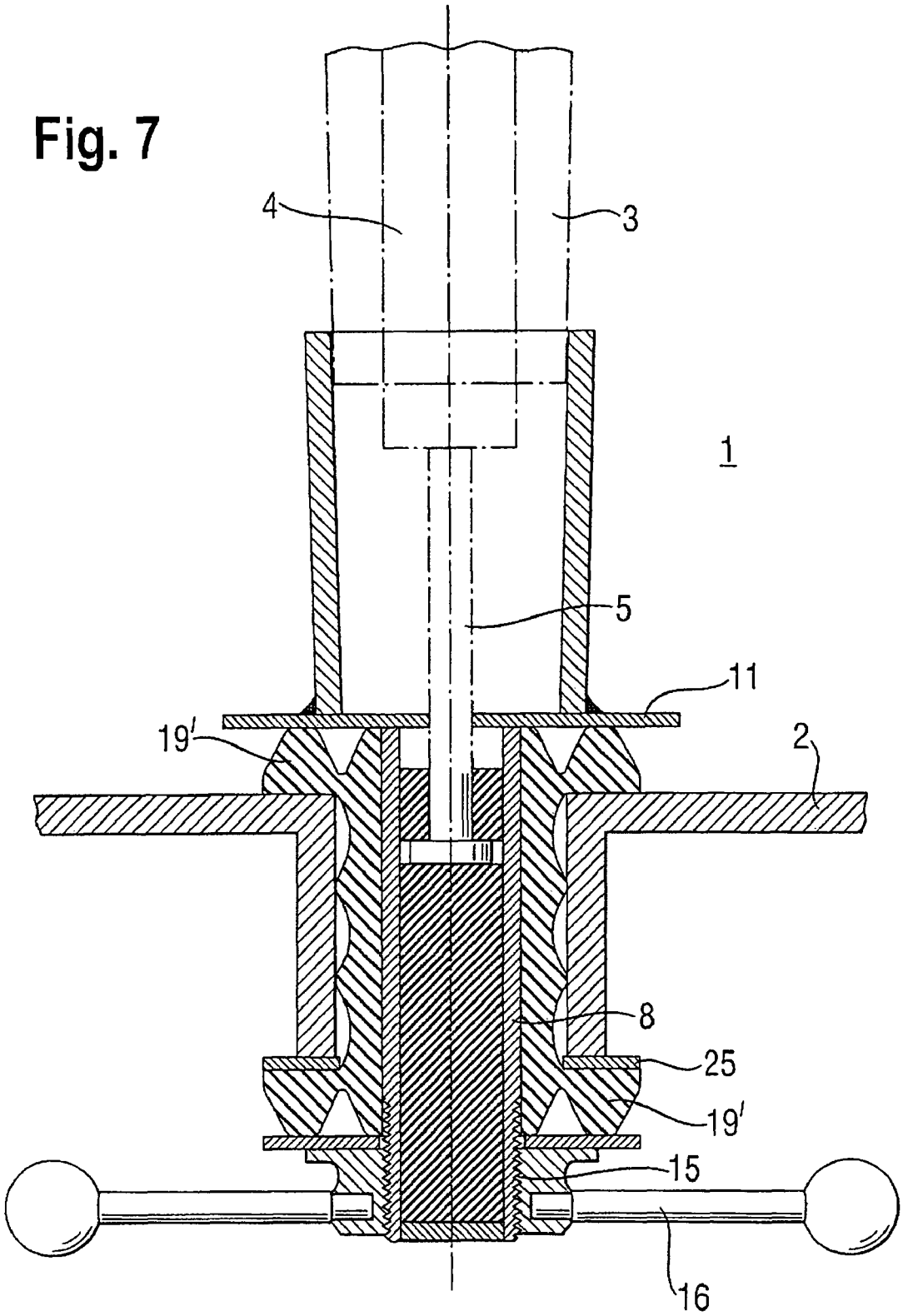
Figure 8:
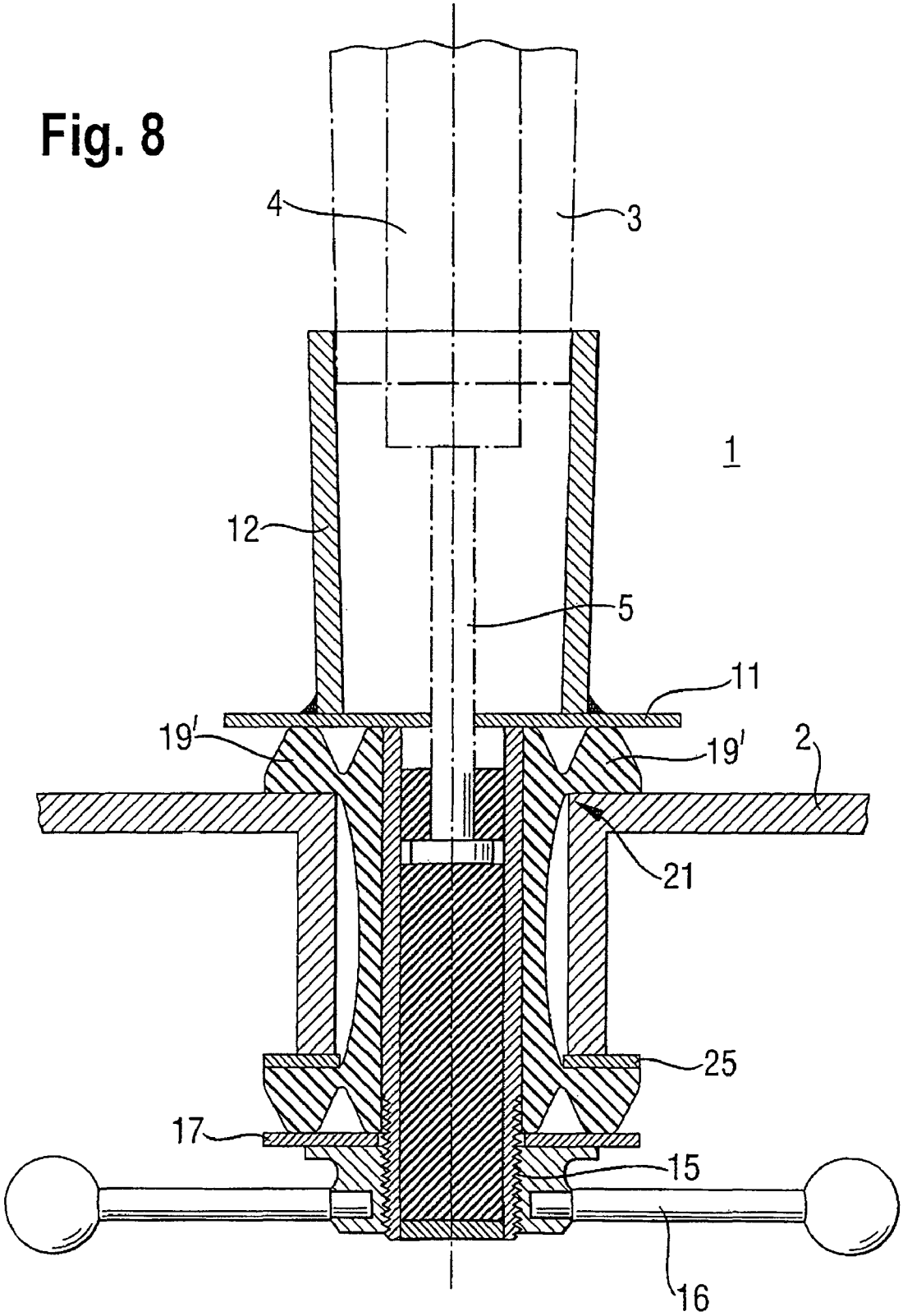

FIG. 5*a* is an illustration of a fifth embodiment of the supporting element; and FIG. 5*b* is a section view taken along the line A-A as shown in FIG. 5*a* of a hose clip used in the fifth embodiment;

FIG. 5*c* is an illustration of an alte arrangement of the hose clip on the supporting element;

FIG. 6 is a side view of a sixth embodiment of the supporting element;

FIG. 7 is a side view of a seventh embodiment of the supporting element;

FIG. 8 is a side view of an eighth embodiment of the supporting element.

Figure 1:
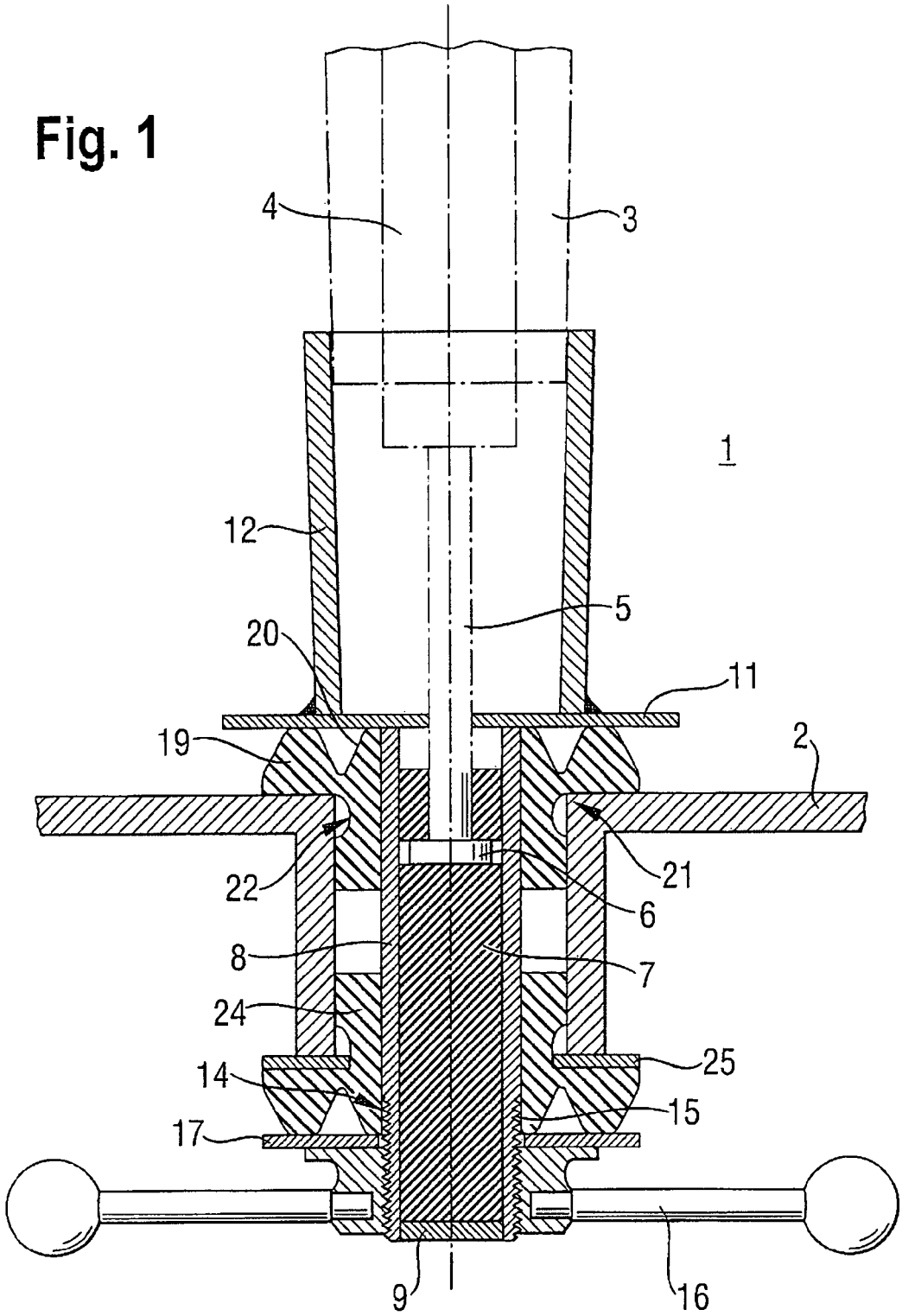

Referring now to FIG. 1 there is illustrated a supporting element 1 for a seating device (not shown) showing in a vertical section view a standing leg as is usual in known office chairs.

The supporting element 1 comprises a five-star base connected to the tubular piece 8 via a jointing element 2 and a resilient element 19, 24. The supporting element 1 for the seat comprises a stanchion tube 3 and a height-adjustable gas spring 4. Swiveling the seat relative to the seat jointing element 2 is possible by means of a corresponding bearing.

As is usual, the height-adjustable gas spring 4 features a securing rod 5, the free end 6 of which is embedded in a resilient element, in this case a rubber cylinder 7 press-fitted in a tubular piece 8 comprising at its lower end a welded bottom piece 9. Setting the height of the seat can be varied by actuating an actuator.

In top-down loading, the end of the securing rod 5 compresses the rubber cylinder 7 with the effect of an in-depth suspension, the hardness of which is a function of how hard the rubber is. Welded to the upper end of the tubular piece 8 is a washer 11 through the circular opening of which the securing rod 5 passes. Welded to the washer 11 is a conical tubular piece 12 mounting the stanchion tube 3 in a press-fit.

Provided at the lower end portion 14 of the tubular piece 8 is a male thread 15 for screw mounting a wing nut 16. Placed on the tubular piece 8 is a second washer 17 contacting the top of the wing nut 16. Disposed between the first washer 11 respectively the tubular piece 8 and the base 2 is a flange-shaped rubber buffer 19 comprising at the top a conically tapered ring groove 20 and in the knee portion 21 an outer ring groove 22. An identical rubber buffer 24 is clamped in place between the second washer 17 respectively the tubular piece 8 and the lower portion of the base 2. Provided between the rubber buffer 24 and the base 2 is a slipper washer 25 to distribute the pressure contact of the narrow underside of the jointing element 2 over a wider contact surface. By means of the wing nut 16 the horizontal travel of the suspension can be set in thus permitting personalized setting of the restoring forces when swinging the seat.

Each of the rubber buffers 19, 24 is configured substantially ring-shaped to clasp the tubular piece 8, although discontinuities may also be provided. The flanges extending outwardly engage between the upper washer 11 and jointing element 2 of the base and respectively between the slipper washer 25 and the lower washer 17 in thus clamping the jointing element 2 of the base in place between the flanges. This makes for a simple gimble mount permitting motion of the seat relative to the base with multiple degrees of freedom, achieved in addition by a simple structure. The rubber buffers 19, 24 are designed for facilitated replacement or retrofitting.

The rubber buffers 19, 24 thus serve as a suspension for the stanchion tube 3 secured to the tubular piece 8 to achieve swiveling and swinging motion of the seat of the office chair to substantial relief and strengthening of the back of the seated person.

Contact between the seat and base is simply via the rubber buffers 19, 24. The supporting element 1 cushions both bobbing and swinging motion of the seat by the seated person.

The described supporting element 1 has a simple structure by the rubber buffers being replaceable when required and retrofitting to existing office chairs being facilitated. In one simplified version the wing nut 16 can be eliminated, the second washer 17 then being likewise secured to the tubular piece 8.

The rubber buffers 19 and 24 and the rubber cylinder 7 are made of a suitable elastomer, for example polyurethane or natural rubber. When using natural rubber it is preferably vulcanized with the securing rod 5 directly in the tubular piece 8. The polyurethane or natural rubber can also be vulcanized together with the helical compression spring in place.

It is this combination of bobbing and controlled swinging movements that motion is now made possible with multiple degrees of freedom. The person skilled in the art will, readily understand that the supporting element 1 can be produced particularly cost-effective in thus adding to the attractiveness of retrofitting existing chairs such as office chairs, and the like, therewith. However, it is just as possible, of course, that the supporting element 1 can be put to use on new office chairs. In this case the stanchion tube 3 can be directly welded to the first washer 11 and the conical tubular piece 12 eliminated.

Figure 2:
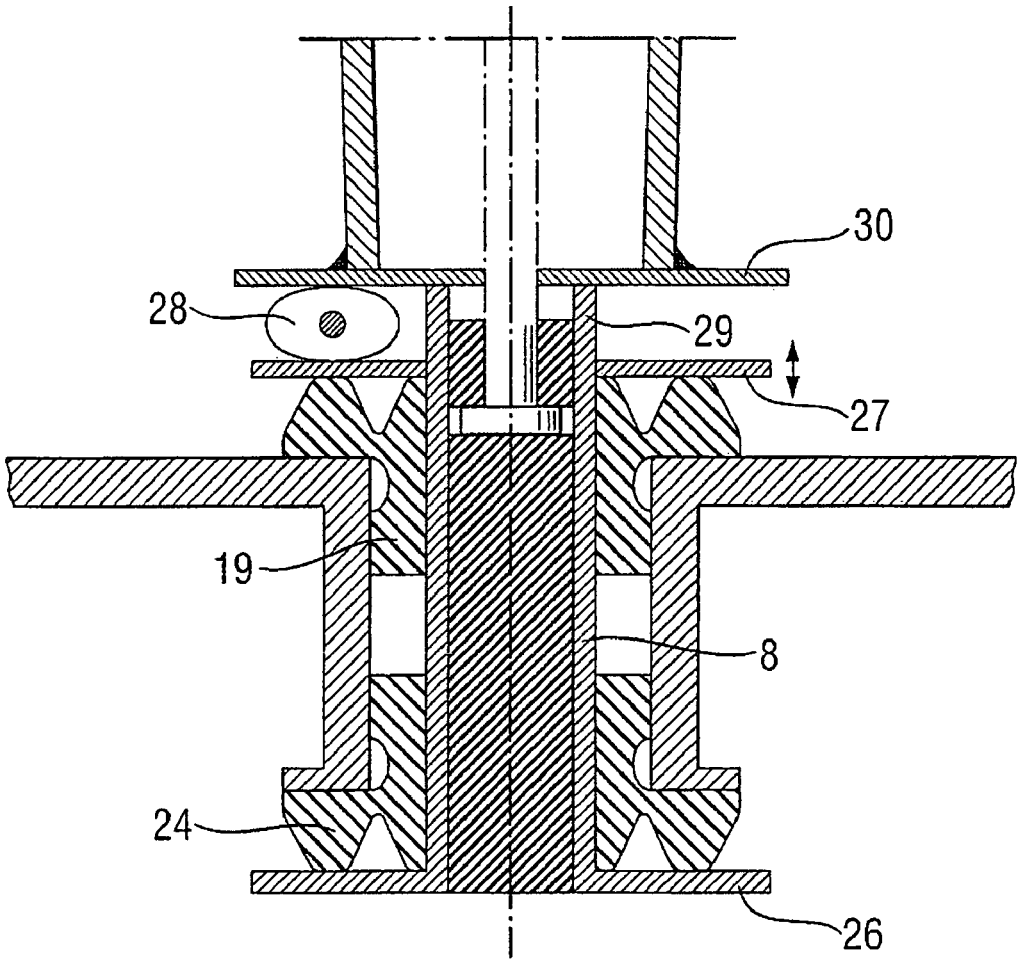
FIG. 2 is an illustration of a second embodiment of the supporting element.

Referring now to FIG. 2 there is illustrated a further embodiment of the supporting element 1 with a connecting device for setting the swinging restoring forces by varying the spacing between a mounting flange 26 rigidly connected to the tubular piece 8 and a height-adjustable upper washer 27. Height-adjusting the washer 27 at the tubular piece 8 is done with the aid of an adjuster of which only a cam 28 is shown in FIG. 2 to simplify the illustration. The cam 28 is disposed, for example, between the height-adjustable washer 27 and the closure flange 30.

In the position of the cam 28 as indicated in FIG. 2 the upper washer 27 is at its highest on the tubular piece 8, meaning that the rubber buffers 19 and 24 receive maximum relief. This setting makes for a relatively gentle swinging motion of the seat relative to the base. Turning the cam 28 by means of a suitable actuator the washer 27 can be shifted further down, resulting in the rubber buffers 19, 24 being compressed in thus making for a harder setting of the return device, i.e. requiring more effort by the seated person to swing the seat. To set the hardness of the rubber buffer for swinging motion the rubber buffer is compressed in the direction of the vertical axis of the tubular piece 8.

The illustration of the height-adjusting means simply showing the cam 28 is greatly simplified in FIG. 2, since, for example, a plurality of cams could be provided at various locations between the washer 27 and the closure flange 30. Apart from this, the cam 28 can be set, as a rule, by turning a handwheel having a certain translation to achieve precise, continuous deformation of the rubber buffers 19 and 24 and setting of the restoring forces. As an alternative, the height of the washer 27 can be set incrementally, for example by a jagged cam or by means of a ratchet lever.

Figure 3:
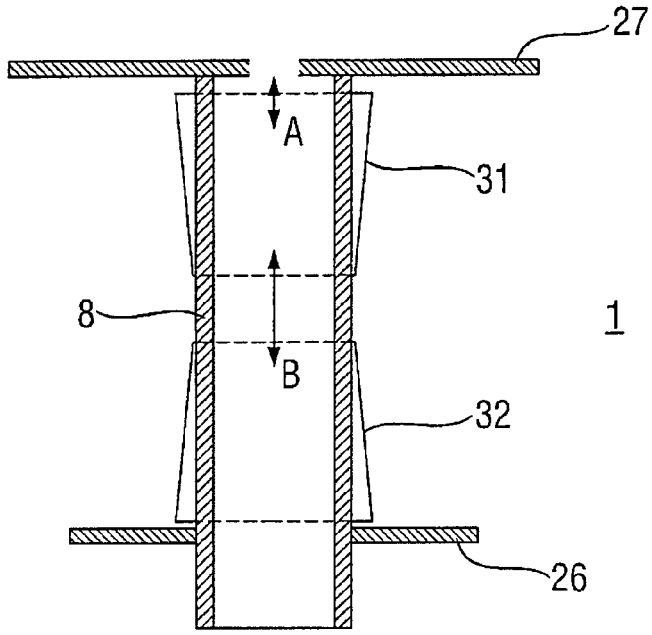
FIG. 3 is an illustration of part of a third embodiment of the supporting element.

Referring now to FIG. 3 there is illustrated part of a supporting element 1 with a means for setting the restoring forces, not showing the rubber buffers and jointing part of the base 2 to make for a better overview. In this embodiment the hardness of the rubber buffer is set by the arrangement of a height-adjustable cone 31 at the tubular piece 8. In addition, a further cone 32 can be arranged fixed or likewise height-adjustable at the tubular piece 8. The lower cone 32 can produce a separate motion and/or motion relative to the upper cone 31. Depending on the height adjustment of the cone(s) at the tubular piece 8 the rubber buffers (not shown) are compressed, resulting in the elastic response of the return device being varied as regards lateral displacement of the rubber buffer. The person skilled in the art knows of various possibilities for setting and adjusting the location of the cones 31, 32 which are not recited in detail presently. For instance, a handwheel or a ratchet lever may serve as the actuator in thus permitting speedy, facilitated setting of the restoring forces.

Figure 4:
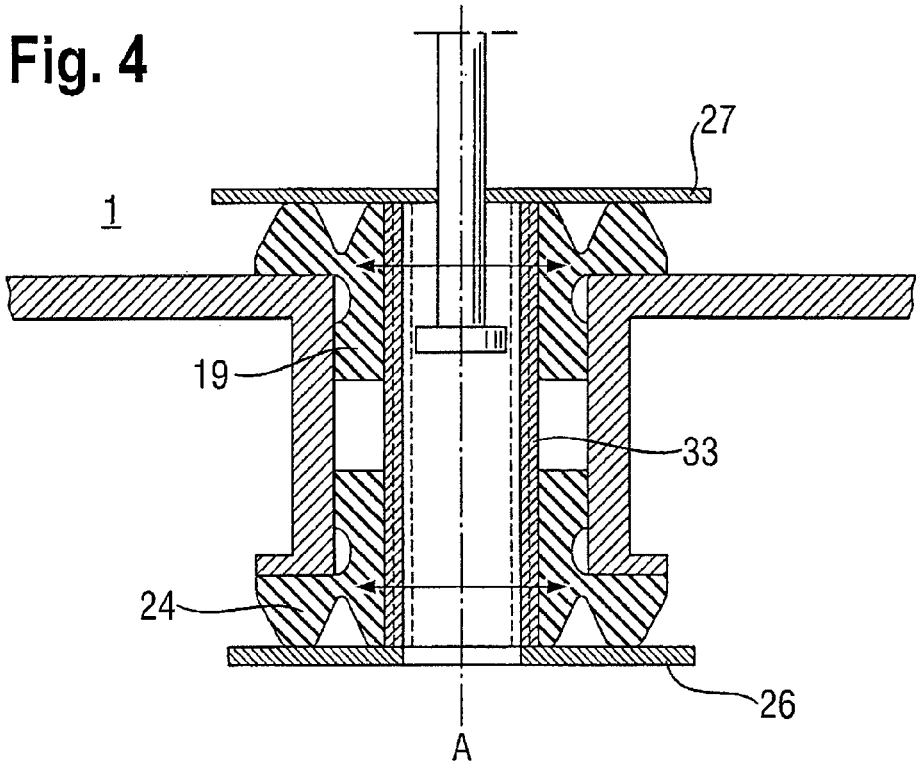
FIG. 4 is an illustration of a fourth embodiment of the supporting element.

Referring now to FIG. 4 there is illustrated a further embodiment of the supporting element 1 showing the connecting device. In this embodiment both stopper flanges 26 and 27 are fixedly located at a given spacing from each other. Compressing the rubber buffers 19 and 24 is done in this case by means of a force acting radially on the rubber buffers 19 and 24. The radial spacing of a wall piece 33 can be varied in accordance with the setting for the wanted hardness of the rubber mount. The wall piece 33 may be configured split as two half shells variably spaced from each other.

Referring now to FIG. 5*a* there is illustrated another variant for setting the restoring forces of the rubber mount. The connecting device comprises hose clips 34 and 35 disposed between the upper stopper flange 26 and jointing element 2 of the base and/or the lower stopper flange 27 and jointing element 2 of the base or slipper washer 25. It is, however, just as conceivable to configure the jointing element 2 of the base so that its inner radius is adjustable to set the spacing to the tubular piece 8. It is in this way that the resilient element can be compressed more or less in thus setting the restoring force.

Referring now to FIG. 5*b* there is illustrated in a section taken along the line A-A of the hose clips 34 as used in the embodiment as shown in FIG. 5*a*. The circumference of the press ring 37 of the hose clip 34 can be varied by the turning an adjuster wheel 36. Reducing the circumference results in the rubber buffers 19 and/or 24 being compressed enabling the hardness of the rubber mount to be set in all. To permit swinging the same as before the hose clips 34, 35 need to be configured relatively flexible in the vertical direction.

Referring now to FIG. 5*c* there is illustrated as an alternative how the hose clips 34, 35 may also be configured flat and adapted, for example, in a groove 38 in the rubber buffers 19 and 24 respectively. Since in this case there is enough motion allowance between the jointing element 2 of the base and the fixed flange 26 for implementing swinging, the flat configured hoe clip 34 can be made of a relatively rigid material in this case.

It is also just as conceivable to arrange a hose clip at the outer portion of the bracket-type jointing element 2 of the base, as long as the bracket(s) is/are configured to permit a radial displacement.

In all, it is to be noted that the features as described relative to the individual example embodiments may also be combined to permit setting the restoring forces as simple and precise as possible.

Referring now to FIG. 6 there is illustrated a further example embodiment of a supporting element 1 in accordance with the invention in a side view, whereby the upper portion with the stanchion tube structure is identical up to the first washer 11.

Provided at the lower end portion 14 of the tubular piece 8 in this case too is a male thread 15 on which a wing nut 16 is screwed. Likewise fitted on the tubular piece 8 is a second washer 17 resting on the top of the wing nut 16.

Disposed between the first washer 11 respectively tubular piece 8 and the jointing element 2 is a flange-type one-piece rubber buffer 19' comprising at the top and bottom a conically tapered ring groove 20 and in the knee portion 21 an outer ring groove 22. Provided between the rubber buffer 19' and the base 2 is, the same as before, a slipper washer 25 to distribute the pressure contact of the narrow underside of the jointing element 2 to a larger surface. Preferably the rubber buffer 19' is symmetrically configured and is shaped at the underside in the region of the slipper washer 25 and the washer 17 identical to the upper side. Here too, by means of the wing nut 16 the horizontal travel of the suspension can be set in thus enabling setting the restoring forces in swinging motion of the seat to be selected personalized.

The rubber buffer 19' is in this case too, configured ring-shaped to clasp the tubular piece 8. The flanges extending outwardly engage between the upper washer 11 and the jointing element 2 of the base, respectively between the slipper washer 25 and the lower washer 17. It is in his way that the jointing element 2 of the base is clamped in place between the flanges. The effects and functions of this rubber buffer 19' are substantially the same as those of the rubber buffers 19, 24 as shown in FIG. 1. The rubber buffer 19' can be easily replaced or retrofitted. Contact between the seat and the base is solely via the rubber buffer 19'. The supporting element 1 cushions likewise both bobbing and swinging motion of the seated person. Too facilitate assembly the rubber buffers 19' may feature longitudinal slots of suitable length and width.

Referring now to FIG. 7 there is illustrated how the embodiment of the supporting element corresponds to that as shown in FIG. 6 except for the shape of the rubber buffer 19' in the one-piece configuration of which an additional hollow of the one-piece rubber buffer 19' is provided in the region between the jointing element 2 and the tubular piece 8. All effects as experienced by the seated person and the means of setting the restoring forces are substantially the same as those of the already discussed embodiments.

Referring now to FIG. 8 there is illustrated how the embodiment of the supporting element 1 likewise corresponds to that as shown in FIG. 6 except for the shape of the rubber buffer 19' in the one-piece configuration of which only one hollow of the rubber buffer 19' extends from the knee portion 21 to the slipper washer 25 in the region between the jointing element 2 and the tubular piece 8. Here too, all effects as experienced by the seated person and the means of setting the restoring forces are substantially the same as those of the already discussed embodiments.

The invention claimed is:

1. A supporting element comprising a first tubular piece at a lower part of the supporting element and a conical second tubular piece at an upper part of the supporting element, for connecting a jointing element adapted to bear a seat with a base, wherein:

the jointing element is formed in the base for connecting the base with the first tubular piece, the jointing element comprising a hollow cylinder, the first tubular piece being inserted into the hollow cylinder of the jointing element and extending beyond open ends of the hollow cylinder of the jointing element, an upper and a lower disc-shaped stopper being fixed above and below the first tubular piece, respectively, the disc-shaped stoppers having an outer diameter being greater than the open ends of the hollow cylinder of the jointing element, resilient elements are disposed between the upper disc-shaped stopper and the jointing element, between the lower disc-shaped stopper and the jointing element, and between respective ends of the hollow cylinder of the jointing element and the first tubular piece, and the conical second tubular piece is supported free to be tilted and returned at the jointing element by means of at least one of the resilient elements.

2. The supporting element, according to claim 1, wherein the resilient elements are configured so that the first tubular piece is clamped in place in the jointing element by the resilient elements.

3. The supporting element according to claim 1, wherein the jointing element is configured as a stanchion tube extending downwards.

4. The supporting element according to claim 1, wherein the resilient elements comprise at least two flanges extending outwardly between which the jointing element is disposed.

5. The supporting element according to claim 1, wherein the resilient elements comprise at least two separate parts.

6. The supporting element according to claim 1, wherein the resilient elements include at least one rubber buffer.

7. The supporting element according to claim 1, wherein the resilient elements are made of at least one elastomer, particularly polyurethane or natural rubber.

8. The supporting element according to claim 1, wherein the resilient elements define cavities and/or recesses in surfaces contacting adjoining components to accommodate a change in shape of the resilient elements.

9. The supporting element according to claim 1, wherein the supporting element comprises means for setting and varying a restoring force of the resilient elements.

10. The supporting element according to claim 9, wherein the supporting element comprises an actuator for setting and varying the restoring force of the resilient elements.

11. The supporting element according to claim 9, wherein the setting and varying means vary spacing between the upper stopper and the lower stopper.

12. The supporting element according to claim 9, wherein the setting and varying means are configured between the conical tubular piece and the jointing element.

13. The supporting element according to claim 1, wherein the resilient elements are configured in one piece as a sleeve having supporting shoulders at both ends, the jointing element being located in a recess between the shoulders.

14. A seat furniture item, wherein said elastomer is an office chair having a seat and a base, wherein the seat furniture item comprises the supporting element according to claim 1.

* * * * *